United States Patent [19]

Lecourtier

[11] Patent Number: 4,831,369

[45] Date of Patent: May 16, 1989

[54] VIDEO ATTRIBUTES DECODER FOR COLOR OR MONOCHROME DISPLAY IN A VIDEOTEXT MODE OR A HIGH-RESOLUTION ALPHANUMERIC MODE

[75] Inventor: Georges Lecourtier, Versailles, France

[73] Assignee: Bull S.A., Paris, France

[21] Appl. No.: 41,008

[22] Filed: Apr. 21, 1987

[30] Foreign Application Priority Data

Apr. 21, 1986 [FR] France ..... 86 05682

[51] Int. Cl.[4] ..... G09G 1/16

[52] U.S. Cl. ..... 340/745; 340/731; 340/748

[58] Field of Search ..... 340/721, 723, 731, 744, 340/728, 735, 747, 748

[56] References Cited

U.S. PATENT DOCUMENTS

| | | | |
|---|---|---|---|
| 3,479,453 | 11/1969 | Townsend | 340/744 |
| 3,903,517 | 9/1975 | Hafner | 340/723 |
| 4,107,786 | 8/1978 | Masaki et al. | 340/731 |
| 4,367,465 | 1/1983 | Mati et al. | 340/707 |
| 4,371,872 | 2/1983 | Rossman | 340/721 |
| 4,555,701 | 11/1985 | Dahl et al. | 340/728 |

*Primary Examiner*—Gerald L. Brigance

*Assistant Examiner*—Mahmond Fatahiyar

*Attorney, Agent, or Firm*—Kerkam, Stowell, Kondracki & Clarke

[57] ABSTRACT

The present invention relates to a video attributes decoder for color or monochrome display in the videotext mode or in the high-resolution alphanumeric mode, with a choice, in the videotext mode, between the alphanumeric and the semigraphic mode. The decoder is made up of a clock circuit (25), a configuration register (23), a character atrributes register (22), a line attributes register (32, 33), an attributes decoding circuit (21) connected to these various registers, a character masking circuit (41), a serializer (40) connected to the masking circuit (41) and to the clock circuit (25), a background inversion circuit (53), a character color control circuit (51) and a background color control circuit (52). The last three circuits are connected at the input to the attribute decoder circuit and at the output to the circuit (50) for multiplexing and controlling the monitor guns. The output (402) of the serializer circuit (40) is transmitted over a dot broadening circuit (54). The output (542) of the dot broadening circuit is connected to an input of the multiplexing circuit. A double-height logic circuit (31) is operably connected between the line attributes register (33) and selection lines (LC0, LC3) for selecting one group of characters within a character generator read-only memory (15).

8 Claims, 7 Drawing Sheets

SRDX*
SRD*
SRDX
SRD
REVCMD
SLOAD
BKFIELD
BORDER
VRRST*
FORGEN
REDFORG
GREFORG
BLUFORG
ROWRST
BAKGEN
A6
A5
A4
SHCLK
RBLANK*
R
G
B
E*
E
50
51
52
53
54
5001
5002
5003
5004
5005
5006
5010
5011
5012
5020
5021
5022
5100
5110
5200
5210
5400
5401
5402
5403
5406
5410
5411
5412
5413
502
503
511
512
521
522
530
531
534
535
541
542
254

FIG. 6

| REVS | ---- | VTX | DSEN | COL | BFM | DIV1 | DIV 0 |
|---|---|---|---|---|---|---|---|

FIG. 7

| A7 | | | | | | | A0 |
|---|---|---|---|---|---|---|---|
| 0 | LI | BK | BL | RV | UL | CS | DL |

| B7 | | | | | | | B0 |
|---|---|---|---|---|---|---|---|
| CHARACTER CODE | | | | | | | |

FIG. 8

| A7 | | | | | | | A0 |
|---|---|---|---|---|---|---|---|
| 0 | R | BK | BL | RV | UL | V | B |

| B7 | | | | | | | B0 |
|---|---|---|---|---|---|---|---|
| CHARACTER CODE | | | | | | | |

FIG. 9

| A7 | A6 | A5 | A4 | | | | A0 |
|---|---|---|---|---|---|---|---|
| 0 | RV | DL | DH | BL | C2 | C1 | C0 |

| B7 | | | | | | | B0 |
|---|---|---|---|---|---|---|---|
| 0 | CHARACTER CODE | | | | | | |

FIG. 10

| A7 | A6 | A5 | A4 | | | | A0 |
|---|---|---|---|---|---|---|---|
| 0 | B2 | B1 | B0 | BL | C2 | C1 | C0 |

| B7 | | | | | | | B0 |
|---|---|---|---|---|---|---|---|
| 1 | L | CHARACTER CODE | | | | | |

FIG. 11

| A7 | | | | | | | A0 |
|---|---|---|---|---|---|---|---|
| 1 | B2 | B1 | B0 | BK | C2 | C1 | C0 |

| B7 | | | | | | | B0 |
|---|---|---|---|---|---|---|---|
| UL | 1 | 1 | 1 | 1 | 1 | 1 | 1 |

VIDEO ATTRIBUTES DECODER FOR COLOR OR MONOCHROME DISPLAY IN A VIDEOTEXT MODE OR A HIGH-RESOLUTION ALPHANUMERIC MODE

FIELD OF THE INVENTION

The present invention relates to a video attributes decoder for a color or monochrome display device operable, in a videotext mode or a high-resolution alphanumeric mode.

BACKGROUND OF THE INVENTION

Video attributes decoders for color or monochrome display in a high-resolution alphanumeric mode typically use what are known as professional terminals. With the video monitors of these alphanumeric terminals, 25 lines of 80 characters each can be displayed.

Terminals known as consultation terminals also exist; these are used in videotext and function in a low-resolution alphamosaic mode, with which 25 lines of 40 columns each can be displayed.

SUMMARY OF THE INVENTION

An object of the present invention is to propose a decoder for video attributes for affording on the same display device both a high-resolution alphanumeric image display (such as on a professional quality terminal) and a semigraphic image display (for videotext).

This first object may be attained by a video attributes decoder for a color or monochrome display operating in the videotext mode or in the high-resolution alphanumeric mode, the decoder including a clock circuit, a configuration register, a character attributes register, a line attributes register, an attributes decoding circuit connected to these various registers, a character masking circuit, a serializer connected to the masking circuit and to the clock circuit, a background inversion circuit, a character color control circuit and a background color control circuit, these last three circuits being connected at the input to the attribute decoder circuit and at the output to the circuit for multiplexing and controlling the monitor guns, characterized in that the output of the serializer circuit is sent over a dot broadening circuit, the output of which is connected to an input of the multiplexing circuit, and that it furthermore includes a double-height logic circuit connected first to the line attributes register and second to the selection lines for selecting one group of characters within a character generator read-only memory.

In the case of a professional alphanumeric terminal, a series of pulses called "pixels" is sent to the monitor for forming the characters. For a professional terminal, a pixel persists for 40 nanoseconds. In this case the phosphorus of the monitor screen does not respond instantaneously, but rather with a time lag, and furthermore it lights up and fades. The result of this functional drawback of the monitor screen is that the brightness of characters is not the same in the vertical portions of the display as in the horizontal portions. In fact, the brightness of the terminal is at a maximum in the horizontal portion of the display where the pixels are being displayed, while the vertical portions appear less bright. Given that on a professional terminal, a pixel represents a dimension of one-fourth of a millimeter on the screen, it will be appreciated that this is a major drawback in a professional terminal. Contrarily, this drawback does not exist in low-range equipment, such as consultation terminals, because the number of dots on the screen is much smaller (480 dots, instead of 800), and consequently the dots are broad enough that this defect does not arise.

A second object of the invention, accordingly, is to provide an attributes decoder that overcomes this disadvantage.

The second object may be attained by a dot broadening circuit that enables broadening the dot by a predetermined value, regardless of the display mode adopted, whether direct i.e., normal or inverted, i.e., reverse.

In another feature of the invention, the circuit for broadening the dot comprises a clock signal inverter, delay multivibrators for the data serialization and inverted data serialization signals, and a combinational logic as a function of the display mode adopted for the data signals, the inverted data signals, and the same signals in delayed form.

A third object of the invention is to provide a video attributes decoder which when functioning in the videotext mode enables the display of double-height alphanumeric characters, regardless of the type of monitor used or of the number of groups that comprise one character.

The third object of the invention may be attained by double-height circuit that enables doubling the height of the charactess regardless of the number of character groups contained in a standard-height character.

In another feature of the invention, the double-height circuit includes means for memorizing the address of the last character group, means for generating a constant value and for adding this constant value to the signal representing the address of the character group and for dividing the result by two so as to constitute the address of the double-height character group in the course of processing.

Further features and advantages of the present invention will become apparent from the ensuing detailed description, referring to the accompanying drawings.

BRIEF DESCRIPTION OF THE DRAWINGS

FIG. 6. shows a configuration byte;

FIGS. 7 and 8 show two bytes for character coding in the alphanumeric mode, for monochrome and color respectively;

FIGS. 9 and 10,show the two character coding bytes for videotext, in the alphanumeric and semigraphic mode, respectively;

FIG. 11 shows the two coding bytes of a marker character;

DESCRIPTION OF THE PREFERRED EMBODIMENTS

Figure 1:
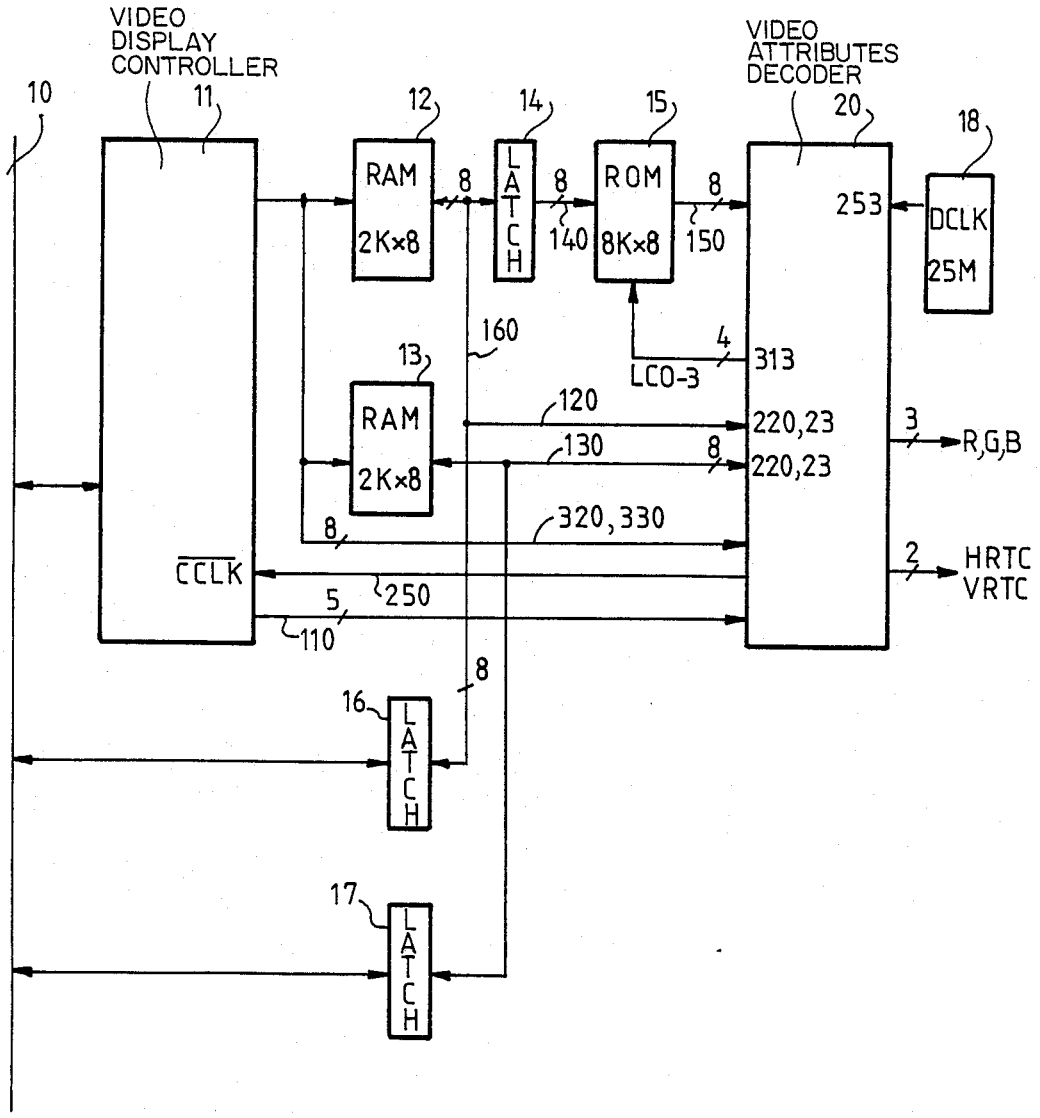
FIG. 1 shows the typical configuration of a video display interface between the bus (10) of a microprocessor and a display monitor, i.e., terminal.

A standard interface between a video monitor, i.e., display device, not shown, and a bus 10 of a microprocessor, also not shown, comprises a video display controller circuit 11, which may be embodied in a known manner by a Signetics SCN 2674 circuit, or by a Motorola MC2674 circuit. This controller 11 communicates with the data, address and control bus 10 of the microprocessor and also receives, via line a 250, a character clock signal from a video attributes decoder 20. From the controller 11, the video attributes decoder 20 receives via five lines 110 the synchronizing signals: HSYNC, the horizontal synchronizing signal; VSYNC, the vertical synchronizing signal; BLANK, the erasing signal; CURSOR, the cursor signal; and RESET, the system reinitializing signal. Via the eight lines 320, 330, this circuit 20 also receives the line control signals from the display address outputs of the video display controller 11. The other display address lines are sent to a first random-access memory or RAM 12 with a capacity for example, of 2 K bytes, comprising the character memory, and to a second RAM 13 with a capacity of 2 K bytes, comprising the attributes memory. The character RAM 12 communicates via its eight data lines 160 with, first, a gate assembly or latch 16 providing access to the bus 10, and second, a gate assembly or latch 14 providing access to the seven lines 140 for selecting the addresss of the 256 characters contained in a read-only memory or ROM 15 comprising the character generator. This ROM 15 has a capacity of 8 K bytes. The line 120 for the most significant data coming from the memory 12 is connected to the input 220 of the video attributes decoder 20. The eight data lines of the RAM 13 for the attributes are connected via the eight attribute lines 130 to the video decoder circuit 20. These eight lines are also connected to a gate or latch 17 for communication with the microprocessor bus 10. The decoder 20 transmits the signals for selection of the group of characters stored in the character generator 15 via the four outputs LC0–LC3 of the output circuit 313. For each character, the character generator 15 stores a representation in accordance with a dot matrix or grid that may comprise a set of nine lines, each line for example including ten dots. The logical value, 0 or 1, of each of these dots makes it possible to reproduce a bright spot or a dark dot on the video screen. The term "group" is used to designate the set of dots in one line of the character matrix. As will be seen below, the character groups may have a size that varies between 8 and 10 dots, so that depending on the monitor used the resolution of the characters can be improved, and one character can comprise from 9 to 16 groups. Finally, decoder 20 receives at its input 253 the output of a clock 18 that operates at a frequency of 25 MHz, for example, and furnishes pulses corresponding to the width of one dot. This dot clock signal is represented as DCLK.

Figure 2:
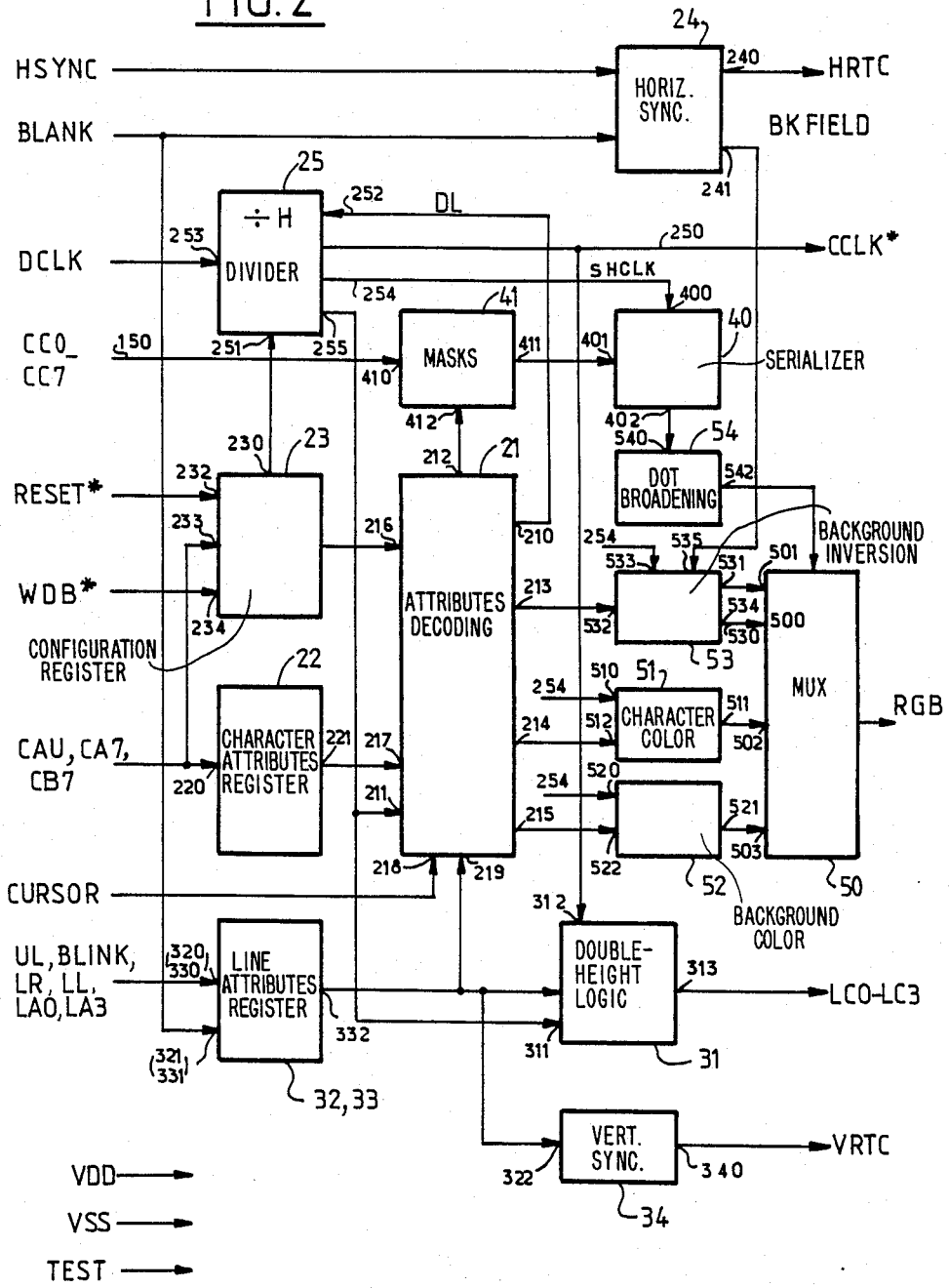
FIG. 2 shows in more detail the video attributes decoder circuit of the configuration of FIG. 1.

FIG. 2 is a diagram showing the video attributes decoder 20 in more detail. This decoder includes a clock divider circuit 25 that divides the clock signal furnished at the input 253 via the output of the clock 18 supplying the 25 MHz clock signal DCLK. This circuit 25 enables pre-dividing of this signal DCLK by two, in accordance with the value of signal DL furnished at the clock divider circuit input 252 via the output 210 of an attributes decoding circuit 21. This signal DL furnished to the input 252 indicates that the character must be of double width. Next, the pre-divided clock signal is itself divided by 8, 9, or 10, depending on the signal furnished at the input 251 of the divider circuit 25. The signal is supplied via the output 230 of a configuration register circuit 23. This clock divider circuit 25 supplies the character clock signal CCLK* over the line 250, and this signal is sent to the corresponding input of the video display controller 11. The output 254 of the clock divider circuit 25 supplies the signal SHCLK, which is the serializing clock signal, and it is sent to the input 400 of the serializing circuit 40. The output 255 of the clock divider circuit 25 is sent, first, to the input 211 of the attributes decoding circuit 21 and, second, to the input 311 of the double-height logic circuit 31. The signal VCCLK supplied to the output 255 is the video characters clock signal. Finally, the signal CCLK* supplied to the output 250 is also sent to the input 312 of the double-height logic circuit 31.

The eight output lines 150 of the ROM 15 representing the character codes CC0–CC7 are sent to a masking circuit 41 comprising the masking logic. The output 411 of this circuit 41 is connected to the input 401 of the serializing circuit 40. One input 412 of the masking circuit 41 receives the output 212 of the attributes decoding circuit 21. The output 402 of the serializing circuit 40 is connected to the input 540 of a dot broadening circuit 54. The output 542 of dot broadening circuit 54 is connected to the input 501 of a multiplexing circuit 50. A background inversion circuit 53 for inverting the background of the screen sends the background inversion signals via its outputs 534 and 530 to the input 500 of the multiplexing circuit 50. One input 533 of this circuit 53 receives the serializ,ing clock signal from the clock divider output 254. The input 532 of this background inversion circuit 53 receives the output 213 of the attributes decoding circuit 21. One output 531 of the circuit 53, which is the inverse of the output 534, is also sent to the input 501.

A character color circuit 51 for controlling the character color receives, at its input 510, the output 254 transmitting the serializing clock signal SHCLK. The output 511 of this circuit 51 is connected to the input 502 of the multiplexing circuit. The input 512 of this circuit 51 receives the output 214 of the attributes decoding circuit 21. A background color circuit 52 for controlling the background color receives, at its input 520, the output 254 that transmits the serializing clock signal SHCLK. The output 521 of this circuit 52 is connected to the inuut 503 of the multiplexing circuit 50. The input 522 of this circuit 52 is connected to the output 215 of the attributes decoding circuit 21. This attributes decoding circuit receives, at its input 216, the output 231 of the configuration register circuit 23. The input 232 of this circuit 23 receives the reinitializing signal RESET* supplied by the video display controller 11. The input 234 receives the signal WDB* supplied by an output of the video display controller 11, which is the signal for writing data into the buffer memories 12, 13. The input 233 of the configuration register circuit 23 receives the nine lines 130, 120 respectively representing the character attributes signals CA0–CA7, on the one hand, and the signal of the most significant bit of the character address CB7, on the other. These signals are also sent to the input 220 of the character attributes register circuit 22 comprising the character attributes register, the output 221 of which is connected to the input 217 of the attributes decoding circuit 21. The output of the video display controller 11 that supplies the signal CURSOR is connected to the input 218 of the attributes decoding video display controller 21. The eight control lines 320, 330 supplied by the circuit 11 are connected to the inputs of the live attributes register circuits 32 and 33, comprising the line attributes register. The inputs 321, 331 of these circuits receive the BLANK erasing signal supplied via a corresponding output of the video display controller 11. The output lines 332 of the line attributes register are connected, first, to the inputs of the double-height logic circuit 31, and, second, to the input 219 of the attributes decoding circuit 21. Finally, the vertical synchronization circuit 34 receives the output lines 322 of the line attribute register 32. The output 340 of this circuit 34 supplies the vertical video synchronization signal VRTC. Also, a horizontal synchronization circuit 24 receives at its input the signals HSYNC and BLANK supplied via the corresponding outputs of the cathode ray tube (CRT) video display controller 11. The output 240 supplies the CRT control signal HRTC, and the output 241 supplies the signal BKFIELD to the input 535 of the background inversion circuit 53.

In operation, the video attributes decoder circuit of FIG. 2 initially receives an 8-bit configuration byte loaded via a command to write the address of a pointer, the address of which is greater than $2^{13}$. This configuration byte is represented in FIG. 6, which shows that the two least-significant bits DIV0, DIV1 make it possible to determine the character width. The next bit, called BFM, serves to modify the extension mode of the serializer: when this bit BFM is at 0, the serializer effects an extension of the character group, while when the bit BFM is at 1, the serializer emits 8 bits. The bit COL, as a function of its value of 0 or 1, selects the color mode, while the bit DSEN, as a function of its value, selects the validation of the dot broadening. VTX selects the videotext mode. The seventh bit is unused, and the eighth bit, REVS, selects the video inversion of the screen. As a function of their value, the first two bits, DIV0 and DIV1, select the width of the character. They select the character width in accordance with Table 1, as follows:

TABLE 1

| DIV1 | DIV0 | CHARACTER WIDTH |
|---|---|---|
| 0 | 0 | 8 DOTS |
| 0 | 1 | 9 DOTS |
| 1 | 1 | 10 DOTS |

FIG. 7 shows the 8-bit byte A0–A7 for the character attributes, and the 8-bit byte B0–B7 of the character address, in an alphanumeric display selected by setting the VTX bit to zero and in a monochrome mode selected by the zero value of the bit COL. The character attribute bits A0–A7, arranged in order of increasing significance, indicate the following functions: The bit DL selects the double width of a line, and this bit is active on the first character of only one row. The bit CS controls the column separator, the bit UL controls underlining of the characters, the bit RV controls the video inversion, the bit BL controls blinking, the bit BK controls secrecy, and the bit LI controls the lowering of brightness, so as to lessen the brightness of the display of a character.

FIG. 8 represents the 8-bit attribute byte A0–A7 and the 8-bit character address byte B0, B7 for alphanumeric color display, with the bit COL set at 1 in the configuration register. In the attribute byte, the bit B controls the blue color, the bit V controls the green color, the bits UL, RV, BL have the same functions as in the monochrome display, and the bit R controls the red color. It will be noted that in FIGS. 7 and 8, the bit A7 is at zero, which makes the following two special commands possible:

(1) an attribute propagation command, which is obtained by positioning the bit A7 of the attribute byte at 1 and all the other bits of this byte at 0. In this case, although the configuration of the attribute byte remains equal to the code 80 in hexadecimal, these latter attributes are still memorized, and they are applicable to all the characters displayed. However, the first character of each row must have the explicit configuration of the attributes selected.

(2) a line erasing command, which comprises all the bits of the attribute byte that are at zero, which makes it possible to mask the video signal RGB until the end of the current row. This signal RGB is forced to the value 000, if the screen is in the normal mode, and to the value 111 if the screen is in the inverted mode.

FIG. 9 shows the coding of the attributes and of the alphanumeric characters in the videotext mode, that is, with the bit VTX equal to 1 in the configuration byte. The shift to the videotext mode causes a division of the base clock signal CLK by two. The width of the character in this mode is programmed over 8 dots, by setting the bits DIV1 and DIV0 to zero. In this mode, the color bit COL is no longer active, and although the bit DSEN is usable it is unnecessary and is programmed to zero, and similarly although the inverse function is valid, it must be programmed to zero in order to meet videotext standards. In the attribute byte of FIG. 9, the bits C0–C2 serve to define the color of the character. With a color monitor, the bit C0, at a value of 1, controls the blue color; the bit C1, at the value of logical 1, controls the red color; and the bit C2, at 1, controls the green color. In the case where a monochrome monitor is used, the three bits C2, C1, C0 enable setting the gray level, with C2 as the most significant bit and C0 as the least significant bit. With the bit BL, blinking of the character can be controlled, and the bit DH controls the double-height display, while DL controls double-width display and the bit RV controls display with an inverted background.

It will be noted that the character code byte has its most significant bit, B7, at the value of logical 0, which makes it possible to select 128 alphanumeric characters in the videotext mode.

FIG. 10 shows the character attribute byte and the character code byte in the videotext display mode for semigraphic characters. In this byte, the bits C2, C1, C0 enable determining the character color as above, or defining eight levels of gray; the bit BK controls the blinking display of the character, and the bits B0, B1, B2 enable determining the background color, by the same conventions as for the definition of the character color in the case of color display, and in the case of a monochrome display they enable defining eight levels of gray. The bit A7 is always at 0. The most significant bit of the character code, bit B7, is at level 1, to indicate that semigraphic characters are involved, and the bits B0–B6 enable selecting 128 semigraphic forms, 64 of which are called separate or lineated forms. These 64 separate or lineated semigraphic forms are selected when the bit L equals 1. It will be noted that this bit L is not processed in the circuit of FIG. 2 but serves simply to address the linear semigraphic characters in the ROM 15.

FIG. 11, finally, shows the attribute character code bytes for a character known as a marker character. With the bits C0–C2 of the attribute byte of this marker character, the color of the marker character can be determined. The bit BK, at the value of 1, enables masking the characters following the marker character, until either the end of the row or until the next marker in which the bit BK is at 0. A marker character is visually shown as a space, not underlined and not blinking, and its color is defined by the bits C0, C1, C2. The bits B0, B1, B2 define the background color for the alphanumeric characters that follow the marker character, until the end of the row or until the next marker. The bit A7 of the attribute byte of the marker character is at level 1, so that this character can be distinguished from those preceding it by the presence of this bit A7. The eighth bit of the character code, B7, makes it possible to use the function of underlined display. The bit UL, when it is at level 1, enables underlining the zone that follows the marker character. The other bits of the character code, B0–B6 are all at level 1. The use of the functions of the diagram shown in FIG. 2, combined with the attribute and character codes of FIGS. 7–10, makes it possible to attain various display combinations, as will be apparent from the above description of the attribute and character codes.

Now that the various functions of the video attribute decoder have been described, the circuits to be used for attaining each of these functions are standard for one skilled in the art, except for the function of dot broadening and the function of the double-height logic circuit. For the standard circuits for one skilled in the art, the novel feature in the attribute decoder circuit is the combination of the various functions with one another and in particular the combination of the standard functions with the function of dot broadening and of the double-height logic. Various possible embodiments of these will now be described.

Figure 3:
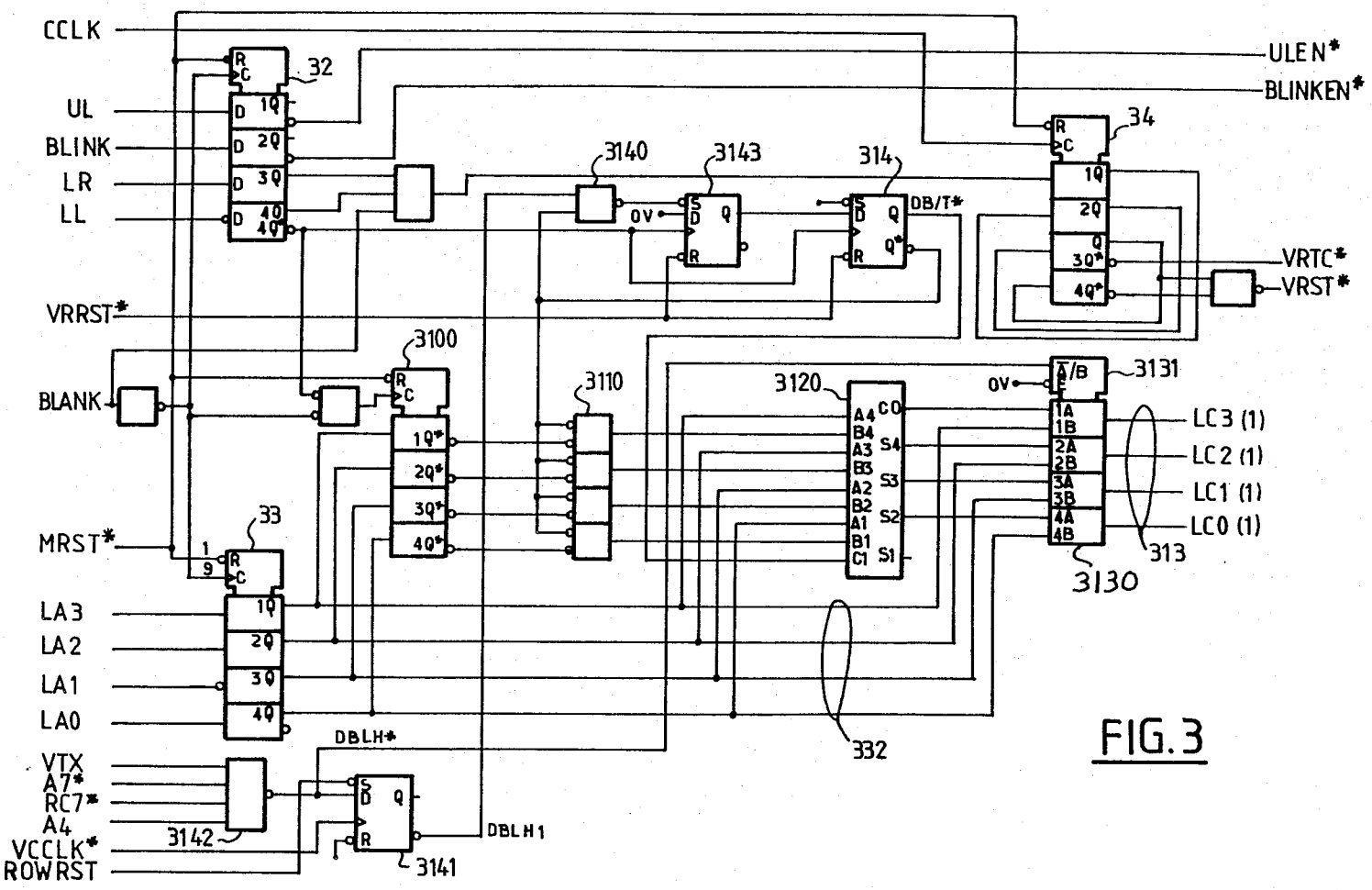
FIG. 3 is an electronic diagram of the signal generating circuit that enables the display of double-height characters.

FIG. 3 shows the double-height logic circuit 31 associated with the line attribute registers 32, 33 and with the vertical synchronization circuit 34. A first line attribute register 32 receives the signals UL, BLINK, LL and LR at its four inputs. These signals, supplied by the circuit 11, indicate underlining, blinking, the last line and the last row, respectively. These registers are synchronized by the erasing signal BLANK supplied by the circuit 11. The second register 33, at its four input lines, receives the line attributes LA0–LA3, which in fact define which line or group of characters within the character matrix is to be processed. The registers 32 and 33 are reinitialized by a signal MRST. The outputs 33–1Q–33–4Q of the register 33 comprise the lines 332 of the double-height logic. This double-height logic includes a register 3100 for memorizing the signals supplied at the output of the line attribute register; this memorization is effected in the circuit 3100 when the last line of a character is being processed. The inverted inputs 1Q*–4Q* of the register 3100 for memorizing the last line of the character are sent to the assembly of four NOR gates at two inputs which comprise a circuit 3110 for making a selection between the value represented by the last character line and a zero value. The outputs of this NOR gate assembly 3110 are connected to the four inputs B1–B4 of an adder circuit 3120, the other inputs A1–A4 of which receive the output signals of the outputs 1Q–4Q of the register 33. The input C1 of the adder 3120, for addition of the carry, is connected to the output Q of a multivibrator 314, of which the Q output, when it is at level 1, and in the case where a double-height character is being processed, signifies that the lower portion of a character is being processed. The lower portion of a character, taking a capital T as an example, is understood to mean the lower portion of the vertical bar of the T. The Q* output of the multivibrator 314 supplies the signal TOP, which indicates that the top of a character is being processed when this signal is at level 1. This Q* output of the multivibrator 314 is connected to each of the two inputs of the four NOR gates comprising the circuit 3110 and is also connected to the input of a NAND gate 3140, the second input of which receives the Q* output of a multivibrator 3141, which at this Q* output supplies the signal DBLH indicating, when it is at level 1, that a double-height character is being processed. When the signal TOP supplied by the Q* output of the multivibrator 314 is at level 1, the outputs of the circuit 3110 are at level 0. Contrarily, when the Q* output of the multivibrator 314 is at level 1, this means that the lower portion of a double-height character is being processed, since the outputs of the circuit 3110 reproduce the signals LLLA0–LLLA3. These signals are sent over the respective inputs B1–B4. The signals LLLA0–LLLA3 correspond to the line attributes of the last line of the character in its upper portion and are supplied by the circuit 3100. The clock input of the multivibrator 314 receives the ouptut signal 4Q* of the register 32, and this signal LL* corresponds to the inverted signal of the last line. The D input of the multivibrator 314 is connected to the Q output of a multivibrator 3143, the input S of which, for setting a level 1, is connected to the output of the NAND gate 3140. The clock input of this multivibrator 3143 is likewise connected to the output 4Q* of the register 32. The reinitializing inputs R of the multivibrators 3143 and 314 are both connected to the signal VRRST*, that is, the video reinitialization signal. At its D input, the multivibrator 3141 receives the output of a NAND gate 3142 having four inputs. The inputs of this NAND gate are, respectively, the signals VTX indicating the videotext mode; the signal A7* indicating that the character is not a marker, or that attribute propagation is in the process of being performed; the signal RC7* indicating that a semigraphic character is being processed; and the signal A4, which when it is at level 1 corresponds to the bit DH of FIG. 9 and indicates the intent to display a double-height character. Consequently, when in the videotext mode without a marker and without attribute propagation, and when double height has been selected, the output of the NAND gate 3142 is at the level 0, which causes the Q* output of the multivibrator 3141 to change to 1. At its clock input, the multivibrator 3141 receives the signal VCCLK that comes from the circuit 25 and comprises the video character clock signal. The S input of this multivibrator 3141 receives the signal ROWRST, which commands the reinitialization of one row. The outputs S2, S3, S4 of the adder 3120 are connected to the inputs 4A, 3A, 2A, respectively, of a multiplexing circuit 3130. The input 1A of the multiplexing circuit 3130 receives the output CO of the adder 3120, the output CO supplying the carryover signal for the addition. The respective inputs 1B–4B of the multiplexer 3130 receive the outputs 1Q–4Q of the line attribute register 33. These outputs represent the signals LA3–LA0, respectively. The control input 3131 of the multiplexing circuit that controls the switching between the input routes A and the input routes B to the multivibrator output is connected to the output of the NAND gate 3142. This output supplies the signal DBLH*, which is at level 1 if there is no intent to display a double-height character. In that case, the input 3131 controlling switching to the routes B and consequently the line attributes LA0–LA3 are transmitted directly to the outputs 4Y–1Y of the multiplexer 3130, which outputs comprise the lines 313 that supply LC0–LC3, respectively, to the character coding ROM. The lines LC0–LC3 make it possible to encode the character groups that are to be serialized to effect the display.

Figure 4:
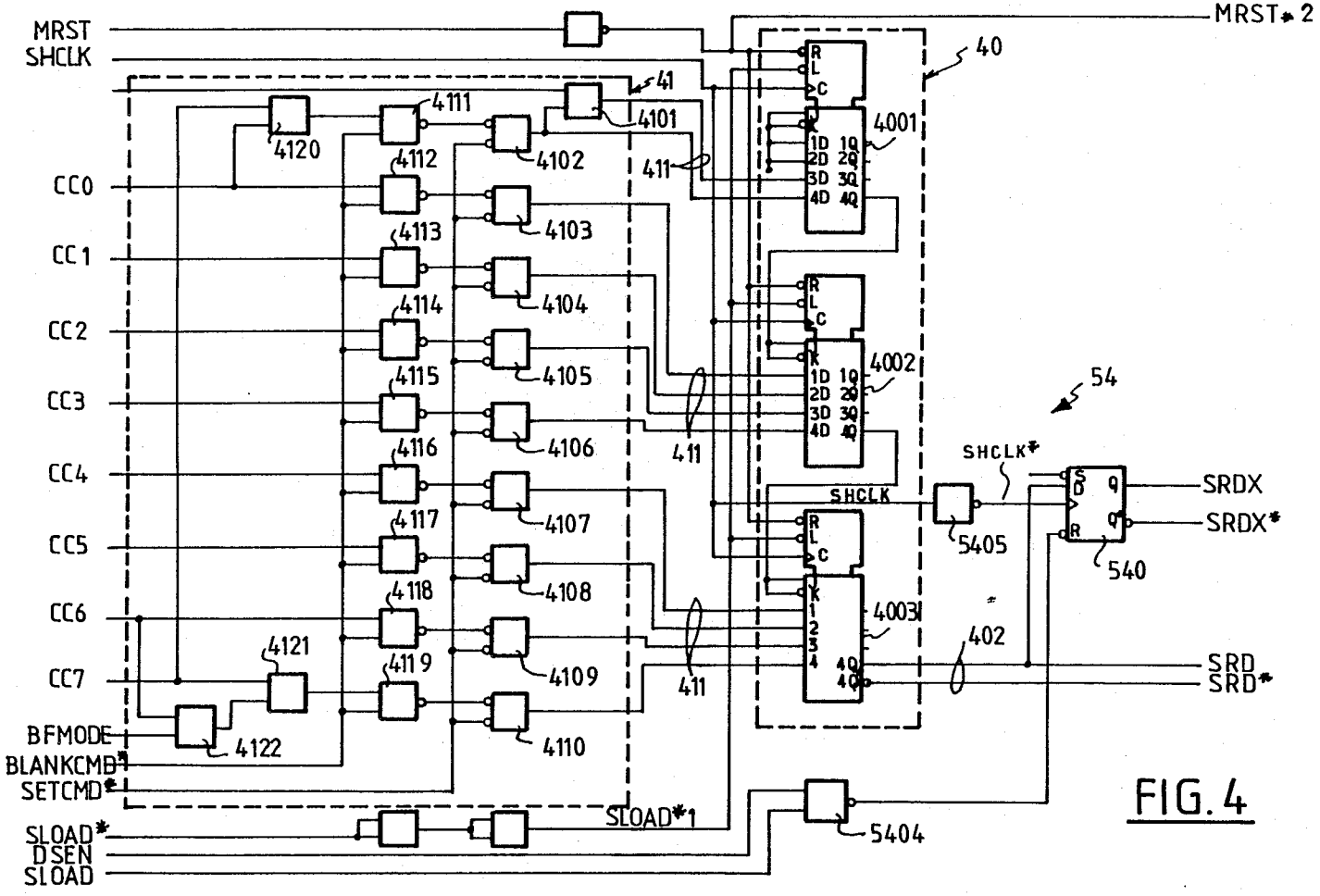
FIGS. 4 and 5 are diagrams of the electronic circuit that enables broadening the character generation dot.
Figure 12:
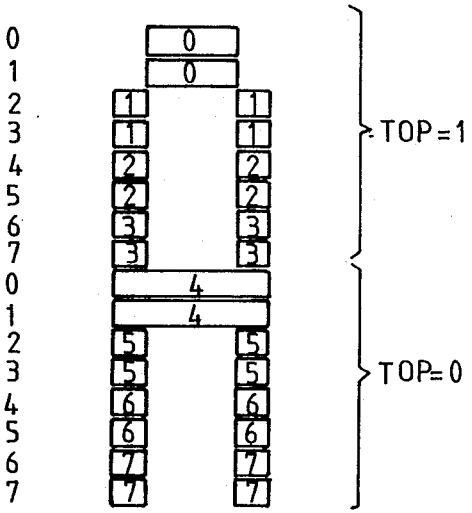
FIG. 12 shows a single-height character and a double-height character.

To facilitate understanding of the description of the double-height circuit 31, FIG. 12 shows, on the left, a character A in standard, or single, height, represented by a matrix of 8 groups of 5 columns each, and, on the right, the same character in double height. The numbers 0–7 for the standard-height character indicate the numbers of the group; these numbers are binary coded by the lines LA0–LA3. To simplify the description, the coding of the lines has been limited to three attribute lines, LA0–LA2. In the column shown between the standard character and the double-height character, the decimal values that correspond to the binary coding of the lines LA0–LA2 are shown, yielding a cycle for displaying a double-height character. To the right of the double-height qharacter, the value of the signal TOP has been shown, indicating whether the upper or lower portion of the double-height character is being processed, and in the display dots of the double-height character, the decimal values corresponding to the binary coding of the signals LC0–LC3 have been shown. The Table 2 below will explain the function of the circuit in the case of coding of the groups of a character over 3 lines LA0–LA2 and the conversion of this code to enable display. The converted code exits via the lines LC0–LC2. In column N, the decimal values corresponding to the group numbers of a standard-height character are shown, while in column NC, the decimal values correspond to the number of the group that must be selected in the ROM 15 in order to enable display of the double-height character. Thus for the upper portion of the double-height character, represented by the portion of the table in which the signal TOP* equals zero, the circuit behaves, for the values LC0–LC2, like a multiplier by a factor of 2 of the values LA0–LA2. In this manner, the character group 0 will be selected twice, over the first two lines of the upper portion of the double-height character. Similarly, for groups 6, 7 of the upper portion of the double-height character, the group 3 of the standard-height character is selected twice. When shifting to the lower portion of the double-height character, this lower portion being signaled by the signal TOP* at the value of logical 1, the signal corresponding to the line of attributes being processed for the standard- height character is added to the carry-over signal comprised by the value of the signal TOP* and the signal LLA corresponding to the value of the attributes line for the last line of the standard-height character prior to the shift to processing of the lower portion. This signal LLA comprises the bit values in the box outlined in broken lines in line 7 of the table. The result of the respective additions yields the respective values of the signals S1–CO for the lower portion of the table, corresponding to the display of the lower portion of the character. Thus once the values picked up by S1 have been eliminated by means of wiring, the values for S2, S3, and S4 are retrieved at the outuputs LC0, LC1, LC2, respectively, of the multiplexer circuit. It will be recalled that the present case is one in which the switching input 3131 selects the routes A and consequently the outputs of the adder circuit, since the signal arriving from the output of the NAND gate 3142 is at level 0. In this manner, the first two lines of the lower portion of the double-height character are constituted by the groups 7, 7 of the standard-height character. The signals LC0–LC3 associated with the signals traveling over the line 140 then enable selection of the group of characters concerned, and the ROM 15 will then transmit the values of the bits corresponding to the required display, over the eight lines CC represented by the connection 150. These eight lines CC0–CC7 are shown in FIG. 4, which shows the masking circuit associated with the serializer 40 and the dot broadening circuit 54. It will certainly be understood that for the sake of simplifying the description, the character has been shown with 5 columns and 8 lines in the drawing, but that the same circuit is equally applicable to characters comprising matrices of 10 to 16 lines and 8 to 10 columns. The importance of this double-height display circuit is precisely that it is independent of the number of lines or groups of the characters.

TABLE 2

| N | LA2 | LA1 | LAO | TOP* | CO | S4 | S3 | S2 | S1 | NC | LC2 | LC1 | LCO |
|---|---|---|---|---|---|---|---|---|---|---|---|---|---|
| 0 | 0 | 0 | 0 | 0 | 0 | 0 | 0 | 0 | 0 | 0 | 0 | 0 | 0 |
| 1 | 0 | 0 | 1 | 0 | 0 | 0 | 0 | 0 | 1 | 0 | 0 | 0 | 0 |
| 2 | 0 | 1 | 0 | 0 | 0 | 0 | 0 | 1 | 0 | 1 | 0 | 0 | 1 |
| 3 | 0 | 1 | 1 | 0 | 0 | 0 | 0 | 1 | 1 | 1 | 0 | 0 | 1 |
| 4 | 1 | 0 | 0 | 0 | 0 | 0 | 1 | 0 | 0 | 2 | 0 | 1 | 0 |
| 5 | 1 | 0 | 1 | 0 | 0 | 0 | 1 | 0 | 1 | 2 | 0 | 1 | 0 |
| 6 | 1 | 1 | 0 | 0 | 0 | 0 | 1 | 1 | 0 | 3 | 0 | 1 | 1 |
| 7 | 1 | 1 | 1 | LLA0 | 0 | 0 | 1 | 1 | 1 | 3 | 0 | 1 | 1 |
| 0 | 0 | 0 | 0 | 1 | 0 | 1 | 0 | 0 | 0 | 4 | 1 | 0 | 0 |
| 1 | 0 | 0 | 1 | 1 | 0 | 1 | 0 | 0 | 1 | 4 | 1 | 0 | 0 |
| 2 | 0 | 1 | 0 | 1 | 0 | 1 | 0 | 1 | 0 | 5 | 1 | 0 | 1 |
| 3 | 0 | 1 | 1 | 1 | 0 | 1 | 0 | 1 | 1 | 5 | 1 | 0 | 1 |
| 4 | 1 | 0 | 0 | 1 | 0 | 1 | 1 | 0 | 0 | 6 | 1 | 1 | 0 |
| 5 | 1 | 0 | 1 | 1 | 0 | 1 | 1 | 0 | 1 | 6 | 1 | 1 | 0 |
| 6 | 1 | 1 | 0 | 1 | 0 | 1 | 1 | 1 | 0 | 7 | 1 | 1 | 1 |
| 7 | 1 | 1 | 1 | 1 | 0 | 1 | 1 | 1 | 1 | 7 | 1 | 1 | 1 |

Figure 5:
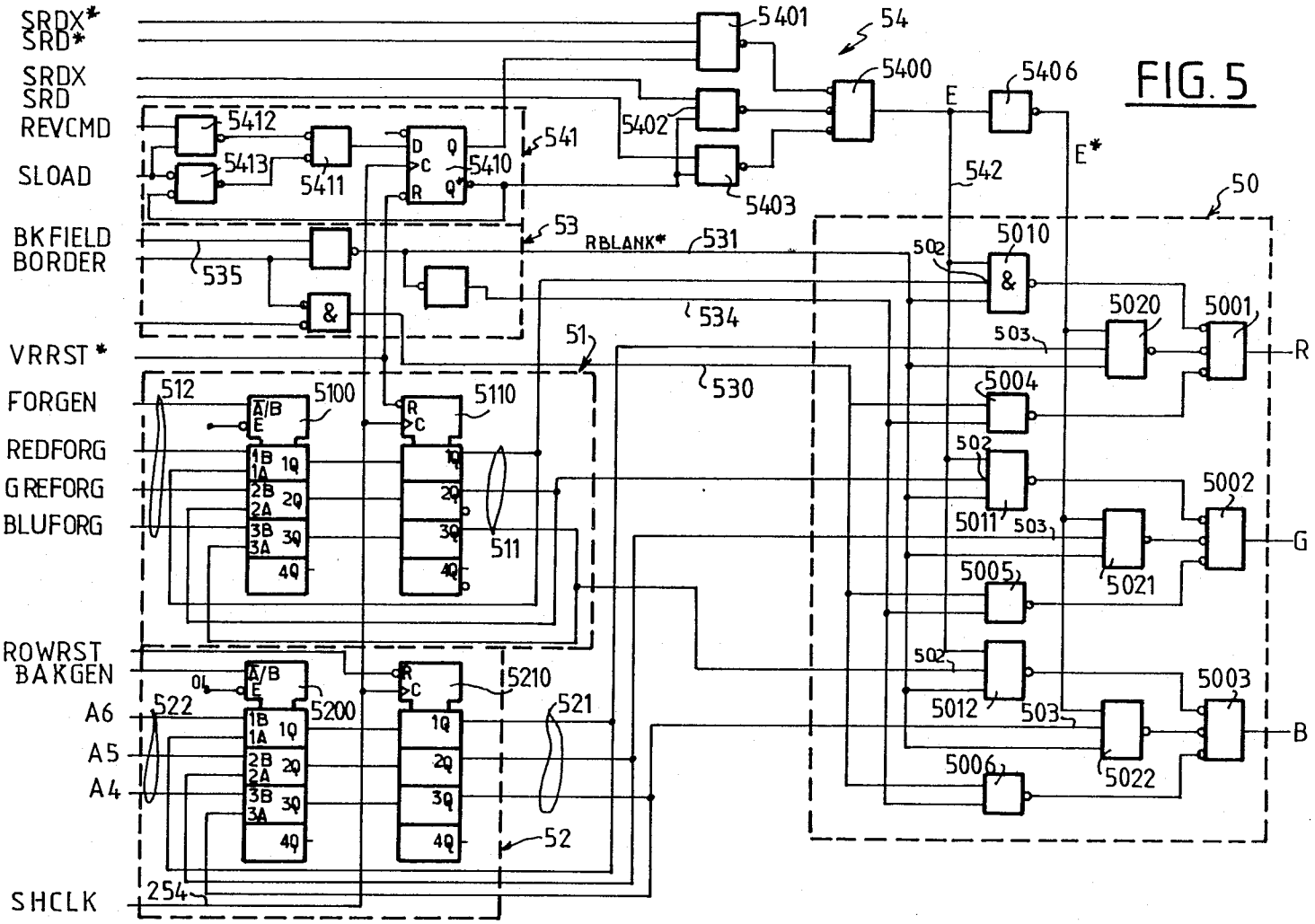

FIGS. 4, 5 show the dot broadening circuit and its association with the other functional blocks of the video attributes decoder. The signals CCO–CC7 leaving the ROM 15 are sent to the corresponding inputs of the circuit mask 41 shown in FIG. 4. In the case of the example selected in FIG. 12 for the group of characters 0, the signals CCO–CC4 are successive and are in the order 0 1 1 1 0. The ten output lines 4II of the circuit mask 41 enable extending the character code over 10 bits in accordance with the values of the command signals COLSEP-CMD and BF-MODE, which stand for the vertical separation attribute command and the extension mode of the serializer 40, respectively. The signals BLANK-CMD and SET-CMD are the signals commanding erasure and the signal commanding the setting of the circuit to 1. With these command signals, by way of the NAND gates 4100–4119, all the characer codes can be masked or set to 1. The ten parallel output lines 411 of the masking circuit 41 are serialized in the serializer comprising three shift registers 4001–4003, the serial ouptuts of which are concatenated, and the parallel inputs of which receive the ten output lines 411. Shifting and serialization is controlled by the signal SHCLCK, that is, the serializing clock signal sent to the input 400 of the shift register 4001. The serialized signal that enables video display is represented by the line SRD, standing for serialized data, which is connected to the output 4Q of the shift register 4003. The inverted serialized data output SRD* is constituted by the output 4Q* of this shift register. The loading inputs of the serializing shift registers are controlled by the signal SLOAD*, that is, the signal for serialization loading. The signal DSEN* for invalidation of the dot broadening and the signal SLOAD for serialization loading are sent to a NOR gate 5405, the output of which is sent to the reset-to-1 input of a multivibrator 540. Then when the serial loading and the invalidation of the dot broadening are at zero, the output of the gate 5404 will command resetting of the multivibrator 540 to 1. At its clock input, the multivibrator 540 receives the output of an inverter 5405, the input of which receives the signal SHCLK, which is the serializing clock signal. This serializing clock signal is inverted by the inverter 5405, which supplies the signal SHCLK*. This D-type multivibrator 540 recives the signal SRD at its D input and at its Q output supplies the signal SRDX, that is, the signal for serialization of the delayed data, and at its Q* output the signal SRDX*, the signal for serialization of the inverted and delayed data. Thus, as will be seen by referring to FIG. 13, the line SHCLK represents the periodicity of the serializing clock signal; the line SHCLK* represents the serializing clock signal shifted by one-half period; the signal SRD represents the signal for serializing the data in the case where a dot that is part of a vertical bar is to be displayed, such as the first dot of group 1 of the character A in FIG. 12. This signal SRD, supplied by the output 4Q of the shift register, has a duration equal to one complete period of the serializing clock signal that controls the serializing registers of the circuit 40. The signal SRDX supplied by the Q output of the multivibrator, as shown in FIG. 13, is shifted by one-half period with respect to the signal SRD.

Figure 13:
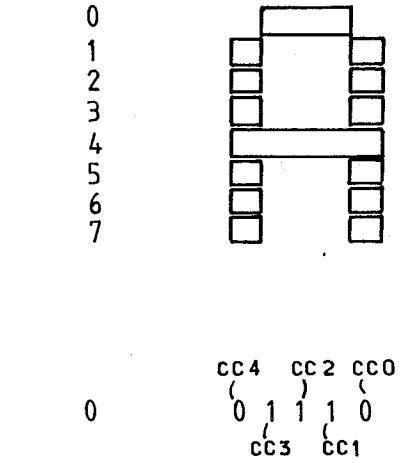
FIG. 13 shows the timing diagrams of the signals used in the dot broadening circuit.

A logic element comprising the circuits 5400, 5401, 5402, 5403 makes it possible, as a function of the signals supplied by a dot inversion circuit 541, to supply a signal E like that shown in FIG. 13. This signal E, as shown, has been prolonged by one-half period with respect to the signal SRD. Consequently, the first dot of group 1 of A has been broadened by a value on the screen that corresponds to one-half the clock period. This circuit accordingly enables amplifying the brightness of the vertical bars in the characters that contain vertical bars. On the other hand, this circuit has no disadvantageous effect on the horizontal bars, because the final effect on a horizontal bar is to lengthen this bar by one-half period.

The NAND gate 5401, having three inputs, receives the signal SRDX*, the delayed and inverted serializing signal, at its first input, the signal SRD*, or inverted serializing signal, at its second input, and the signal furnished by the Q output of a multivibrator 5401 at its third output. The output of this NAND gate 5401 is sent to a first input of a NAND gate 5400, which delivers the signal E shown in FIG. 13 to the multiplexing circuit 50. A branching inverter 5406 at the output 542 makes it possible to supply at its output a signal E*, that is, an inverted signal, which is also sent to the multiplexer 50. The second input of the NAND gate 5400 receives the output of a NAND gate 5402 having two inputs, the first input receiving the signal SRDX, that is, the signal for serializing the delayed data, and the second input receiving the output Q* of a multivibrator 5410. The third input of the NAND gate 5400 receives the output of a NAND gate 5403 having two inputs, the first input of which receives the signal SRD, for serializing data, and the second input of which receives the Q* output of a multivibrator 5410.

The Q output of the multivibrator 5410, when it is at level 1, indicates that the corresponding dot of the character must be inverted. In this case, this Q output, which is sent via the NAND gate 5401, validates the inputs of this NAND gate, and so it is the output signal of this NAND gate 5401 that is transmitted via the NAND gate 5400 to comprise the signal E. Since Q is at level 1, Q* is at level 0, and accordingly the NAND gates 5402, 5403 supply the levels 1 at their outputs, which serve uniquely to validate the transmission of the output signal of the gate 5401. In the inverse case, Q becomes 0 and the output of the gate 5401 is at level 1 and at the gate 5400 validates the transmission of the output signals of the gates 5402, 5403. In this case, Q* is at level 1 and consequently the signal SRDX received at the input of the gate 5402 is reproduced, after inversion at the output, and the signal SRD, subjected to the same operation, exits through the gate 5403. The inverted signal SRDX and the inverted signal SRD are thus available at the input of the NAND gate 5400, which is equivalent to two inverters at the input and one OR gate following it; this assures the addition at the output 542 of the two signals SRD and SRDX and consequently assures that the dot broadening signal will be supplied. The circuit 541 that controls the inversion of the dot comprises a D multivibrator 5410, the D control input of which receives the output of a NAND gate 5411 having two inputs. The first input of this NAND gate 5411 receives the output of a NAND gate 5412 having two inputs, the first in put of which receives the signal REV-CMD, that is, the signal commanding the inversion, which is supplied by the bit RVS of the configuration byte shown in FIG. 6. The second input of this NAND gate 5412 receives the signal SLOAD, that is, the signal commanding loading of the serializer. This signal is also sent to the first input of another NAND gate 5413 having two inputs. At its second input, this NAND gate 5413 receives the Q* output of the multivibrator 5410. The output of this NAND gate 5413 is sent to the second input of the gate 5411. The multivibrator 5410 is synchronized with the rest of the circuit by the signal SHCLK and is reinitialized by the signal VRST*, that is, the video reinitializing signal.

The function of the dot inversion circuit is as follows. When the signal REV-CMD is at level 1, so as to indicate a command to invert the dot of the character because of the cursor, the Q output of the multivibrator 5410 is at level 0, and the Q* output is at level 1. Since a character is in the process of being output, the signal SLOAD is also at level 1. As a result, the gates 5412 and 5413 that receive levels of 1 at their inputs supply levels of 0 at their outputs. The gate 5411, receiving levels of 0 at its input, supplies a level 1 at its output, which acts upon the D input of the multivibrator 5410 and makes its Q output shift from level 0 to level 1 at the next clock pulse SHCLK. At this moment, Q* shifts to level 0, and hence the output of the gate 5413 shifts to level 1, and the output of the gate 5411 maintains the value of the signal REV-CMD. As soon as this inversion control signal returns to level 0, the output of the gate 5411 also returns to level 0, causing the Q output of the multivibrator 5410 to drop to level 0 as well. In this case, the dot is no longer inverted.

The multiplexing circuit 50 comprises 3 NAND gates 5001, 5002, 5003, the respective outputs of which represent the signals R, G, B, that is, signals commanding the display of the colors red, green and blue, respectively. At the first of its three inputs, the output gate 5001 receives the output of a NAND gate 5010 having three inputs, the first input of which receives the signal E and the second input of which receives on of the output lines 511 of the character color control circuit 51. This line 511 comprises the line controlling the color red. The third input of the gate 5010 receives an output line 531 of the background inversion control circuit 53. The output line 531 supplies the signal RBLANK*, which commands erasure of the screen when it is at the level of logical 0. The second input of the gate 5001 receives the output of a gate 5020, the first input of which receives the output of the inverter 5406 that supplies the signal E*. The second input receives one of the output lines 521 of the background color circuit 52 controlling the background color of the screen. This line is the one corresponding to the control of red in the background. The third input of this gate 5020 receives the line 531. The third input of the gate 5001 receives the output of a gate 5004 having two inputs, the first input of which receives a signal REVSCREEN, for inversion of the screen when it is at the level of logical 1. This signal REVSCREEN is supplied by the line 530. The second .input of which gate 5004 receives the output 534 of the background inversion circuit 53 for inverting the background. This output 534 supplies the signal RBLANK for erasing the screeen when it is at the level of logical 1. The NAND gate 5200 corresponding to the color green will be connected to a gate 5011, the output of which determines the color of the shape of the character, to a gate 5021 the output of which determines the background color, and to a gate 5005 the output of which determines whether inversion of the screen must be performed. Similarly, the gate 5003, the output of which supplies the blue color control signal on a color monitor, will be connected to the output of a gate 5012, the output of which determines the color of the shape of the character, to the output of the gate 5022 the output of which determines the background color, and to the output of a gate 5006 which controls the inversion of the screen. The character color and background color circuits 51, 52 each comprise a register 5110 and 5210, respectively, each having three multivibrators, which are synchronized by the signal SHCLK and are reinitialized by the signals VRRST* and ROWRST*, respectively. The three Q outputs of each of these registers are connected to the inputs 1A–3A of the respective multiplexers 5100, 5200. The inputs 1B–3B of the multiplexer 5100 receive the signals REDFORG, controlling a red character, GREFORG, controlling a green character, and BLUFORG, controlling a blue character. Similarly, the inputs 1B–3B of the multiplexer 5200 receive the signals A6–A4 controlling a red, green and blue background, respectively. The multiplexers 5100, 5200 are controlled by the signals FORGEN and BAKGEN, respectively, for character and background validation. The signals FORGEN and BAKGEN make it possible to assure that respective color commands (REDFORG–BLUFORG and A6–A4) will be taken into account by the registers 5110 and 5210 at the time of a first pixel of a character, After that, the feedback of the outputs Q to the inputs A of the multiplexers assures that the commands will be maintained during the entire duration of the character, when the signals REDFORG–BLUFORG and A6–A4 already correspond to the following character.

The other circuits that attain the functions described in conjunction with FIG. 2 are standard circuits known to one skilled in the art and so will not be described in further detail.

Additional modifications within the competence of one skilled in the art can be made without departing from the spirit and scope of the invention.

What is claimed is:

1. Video interface apparatus for controlling a display device which operates in a videotext alphanumeric or semigraphics mode and in a high-resolution alphanumeric mode, the apparatus comprising:

a character generator including memory means for storing codes corresponding to characters for display, each character being stored as a representation in a dot matrix comprising a plurality of groups of dots, each group constituting a line of dots;

a clock circuit for dividing an input clock signal by preselected factors;

means for receiving and storing character attribute signals designating attributes of a character to be displayed;

attributes decoding means for decoding the attribute signals and for supplying to the clock circuit a first control signal for dividing the input clock signal by a first preselected factor for increasing the width of the character to be displayed in response to a character attribute signal designating an increased width, the character attribute signal receiving and storing means having means for supplying a second control signal to the clock circuit for dividing the clock signal by a second preselected factor in accordance with the mode of the display device;

line attributes receiving and storing means for receiving and storing line attribute signals designating attributes of a display line;

double-height logic means responsive to outputs from the line attributes receiving and storing means and from the clock circuit for selecting a group of dots of the character to be displayed;

dot broadening means for broadening the dots of the selected group of the character to be displayed;

and output means connected to the dot broadening means for controlling the display device in accordance with the dots to display said character.

2. The apparatus of claim 1 further comprising serializer means for receiving the selected group of dots of the character to be displayed and a divided clock signal from the clock circuit and for supplying to the dot broadening means an output signal corresponding to the selected group.

3. The apparatus of claim 2, wherein the dot broadening circuit includes means responsive to the serializer output signal for broadening a dot by an amount corresponding to a one-half clock period.

4. The apparatus of claim 3, wherein the dot broadening circuit comprises a clock signal inverter for inverting a divided output clock signal from said clock circuit, a delay multivibrator connected to an output of the clock signal inverter for providing serialized delayed signals for display of the character, and logic means responsive to said delayed signals from the multivibrator and to corresponding signals which are delayed as a function of the display mode for combining such signals and for providing a composite output signal to said output means.

5. The apparatus of claim 1, wherein said character attributes signals include signals which specify character and background colors and a normal/inverted image, and wherein said apparatus further comprises a character color control circuit, a background color control circuit, and a background inversion circuit, such circuits being connected to outputs from the attributes decoding means, and wherein the attributes decoding means is responsive to the character attributes signals for controlling said circuits to afford said character and background colors and an inverted image.

6. The apparatus of claim 1, wherein the doubleheight logic means includes means for selecting the same group of dots for two consecutive lines of display in order to double the height of the character.

7. The apparatus of claim 6, wherein the group selecting means comprises means for providing signals to the memory means for designating the selected group of dots.

8. The apparatus of claim 1, wherein the doubleheight logic circuit comprises memory means for storing an address of a last character group, means for generating a constant value, divider/adder means for adding the constant value to a signal representing the character group to produce a resultant signal; means for memorizing the resultant signal and for dividing said resultant signal by a factor of two to constitute an address of the character group; means for supplying the address to a group address input of the memory of said character generator means; and means for selecting the output from either the divider/adder means or from said line attributes receiving and storing means for producing signals for selecting said group of dots.

* * * * *